US005609080A

United States Patent [19]

Flavigny

[11] Patent Number: 5,609,080

[45] Date of Patent: Mar. 11, 1997

[54] LOCKING PLIERS

[75] Inventor: Jean-Pierre Flavigny, Linas, France

[73] Assignee: FACOM, Morangis Cedex, France

[21] Appl. No.: 447,027

[22] Filed: May 22, 1995

[30] Foreign Application Priority Data

May 20, 1994 [FR] France ..... 94 06192

[51] Int. Cl.[6] ..... B25B 7/12

[52] U.S. Cl. ..... 81/368; 81/375

[58] Field of Search ..... 81/367–380

[56] References Cited

U.S. PATENT DOCUMENTS

| | | | |
|---|---|---|---|
| Re. 32,614 | 3/1988 | Wilson | 81/367 |
| 2,366,015 | 12/1944 | Fischer . | |
| 2,587,673 | 3/1952 | Aden | 81/375 |
| 2,589,511 | 3/1952 | Redmon | 81/372 X |
| 2,592,803 | 4/1952 | Heim | 81/372 X |
| 2,598,650 | 5/1952 | Smith et al. . | |
| 3,657,948 | 4/1972 | Myers | 81/367 |
| 4,730,524 | 3/1988 | Petersen | 81/367 |
| 5,267,464 | 12/1993 | Cleland . | |

FOREIGN PATENT DOCUMENTS

| | | | |
|---|---|---|---|
| 58708 | 3/1954 | France . | |
| 1450235 | 7/1966 | France . | |
| 2440814 | 6/1980 | France . | |
| 581667 | 7/1959 | United Kingdom | 81/368 |

*Primary Examiner*—James G. Smith
*Attorney, Agent, or Firm*—Wenderoth, Lind & Ponack

[57] ABSTRACT

Locking pliers including fixed unit of generally elongate shape which forms at one end a fixed handle and at the other end a fixed jaw. A movable unit includes a movable jaw articulated to the fixed jaw, and an actuating lever of which one end is articulated to the movable jaw and the other end forms a movable handle. Also, a toggle mechanism is provided and includes a link articulated to an intermediate point of the lever and extending to a rear bearing point adjustable along the length of the fixed handle. The actuating lever crosses a straight line which joins the articulation of the movable jaw to the bearing point of the link, and the fixed handle extends substantially along a straight line joining the articulation to the bearing point.

24 Claims, 5 Drawing Sheets

D1
D2
VI
VII
IX
V

FIG.16
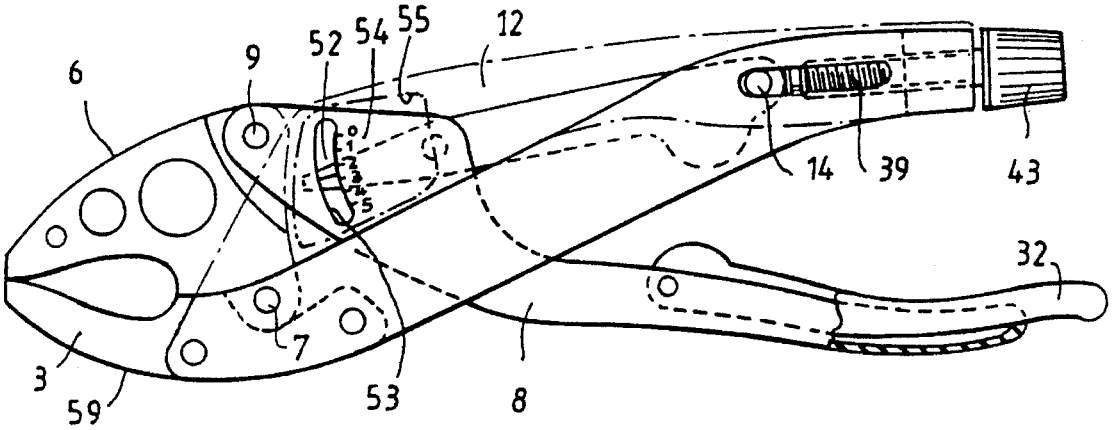
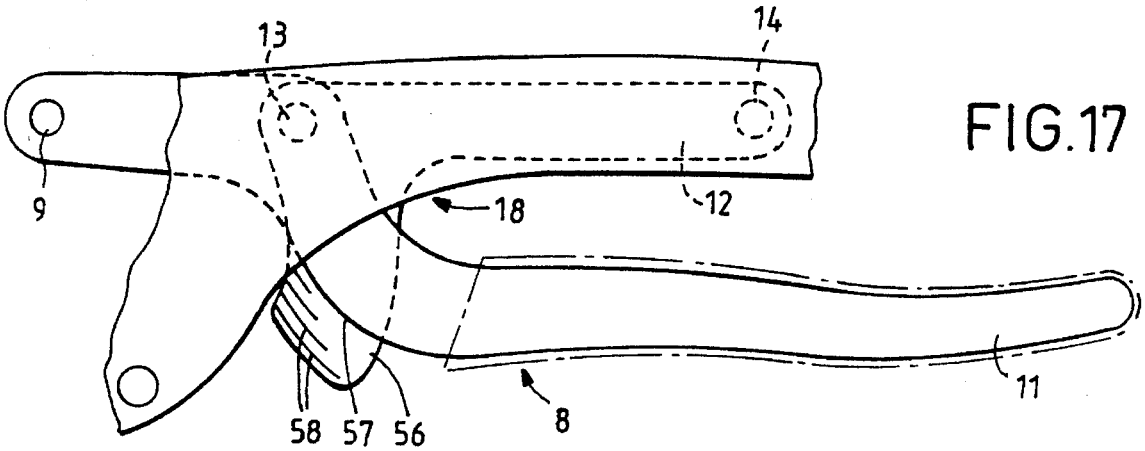
FIG.17
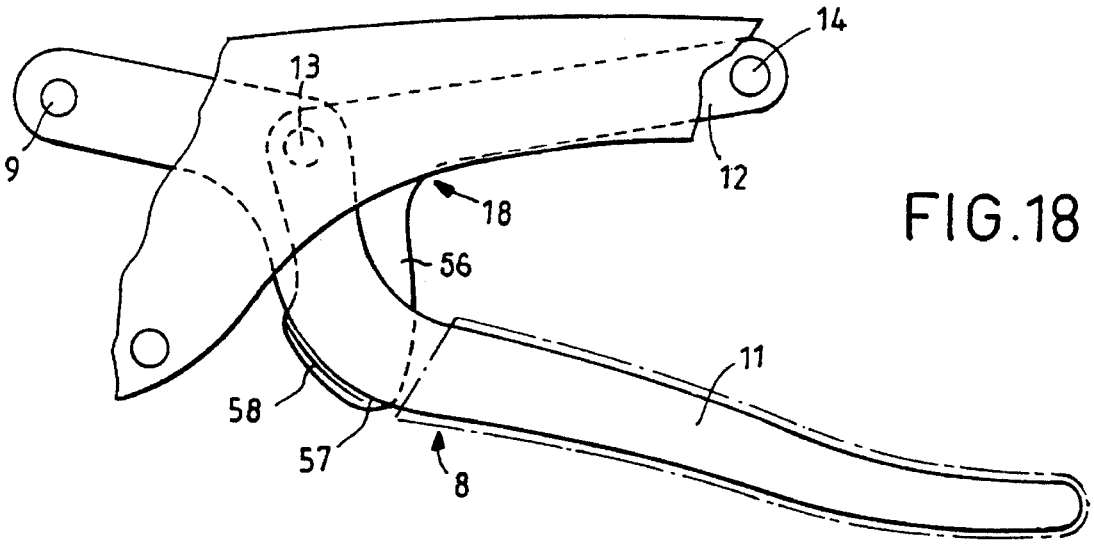
FIG.18

LOCKING PLIERS

BACKGROUND OF THE INVENTION

The present invention relates to locking pliers of the type comprising: a fixed unit of generally elongate shape which forms at the rear end thereof a fixed handle and at the front end thereof a fixed jaw; a movable unit comprising on one hand a movable jaw mounted on the fixed jaw by means of a pivot pin, and on the other hand an actuating lever the front end of which is articulated to the movable jaw and the rear end of which forms a movable handle; and a toggle mechanism comprising a link articulated at the front end thereof to an intermediate point of the lever and extending to a rear bearing point connected to the fixed handle, means for adjusting the position of said rear point along the fixed handle, and a return spring acting in a direction for opening the movable jaw.

In conventional locking pliers of this type, the movable jaw and the actuating lever are located completely on the same side of the fixed unit. Consequently, the user generally does not see the movement of the movable jaw which is located under the part to be gripped, and the line of action of the toggle mechanism is oblique relative to the fixed handle. The latter is therefore subjected to large and repeated bending forces with the following two consequences: the fixed unit must be so designed as to resiliently resist these bending forces and, upon the unlocking, the resilient energy it has stored is released at one time and results in a shock in the hand of the user.

An object of the invention is to avoid these drawbacks, that is to provide locking pliers which are distinctly more convenient and pleasant to use and permit greater freedom of design.

SUMMARY OF THE INVENTION

The invention therefore provides locking pliers of the aforementioned type, characterized in that the actuating lever crosses a straight line which joins the pivot pin of the movable jaw to the rear bearing point of the link, the displacement of the rear bearing point modifies the angular position of the straight line relative to the fixed unit, and, in all closed positions of the locking pliers, the fixed handle extends substantially along a geometrical straight line defined by said articulation of the lever to the movable jaw and by the rear bearing point of the link.

The locking pliers according to the present invention may include one or more of the following features:

The pliers may include means independent of the return spring for maintaining the rear end of the link at an adjustable bearing point;

Also, in the closed position of the locking pliers, the fixed handle extends substantially along a geometrical straight line defined by said articulation of the lever to the movable jaw and by the bearing point of the link;

The rear end of the link is articulated to an adjusting screw screwed in the rear end of the fixed unit.

The rear end of the link carries a transverse pin which is guided in two longitudinal oblong openings in the fixed handle.

The rear end of the link carries a block which is guided along the fixed handle and in which is screwed an adjusting screw rotatively mounted and immobilized in translation at the rear end of the fixed unit.

The locking pliers include a second spring which biases the rear end of the link against an adjusting screw screwed in the rear end of the fixed unit.

The return spring is stretched between the two jaws.

The fixed unit carries a control member which is movable between two positions and prevents, in one of the positions, the toggle mechanism from passing through the position of alignment thereof.

The link and the lever carry, one an index and the other a graduation cooperative with the index in accordance with the position of the bearing point.

The fixed unit laterally overlaps on each side at least the major part of a region defined by the pivot pin of the two jaws, the articulation of the actuating lever on the movable jaw and the bearing point of the link.

The fixed handle, and optionally the actuating lever and/or the link and/or the jaws, are constructed from blanked-out planar sheets optionally completed with spacer members in particular of plastics material.

The locking pliers include an unlocking lever articulated to an intermediate point of the actuating lever and receive, at rest, in a relatively soft padding of said actuating lever.

The link and/or the actuating lever have a longitudinal resilience in compression, at least up to a predetermined compression force.

The resilience is imparted by a U-shaped part which defines a slot which intersects the line of action in compression and is adapted to close when the predetermined force is reached.

BRIEF DESCRIPTION OF THE DRAWINGS

Embodiments of the invention will now be described with reference to the accompanying drawings in which:

FIG. 16 is a view of an alternative embodiment of the locking pliers of FIG. 4;

FIG. 17 is a partial view of another alternative embodiment in a first position of adjustment;

FIG. 18 is a view similar to FIG. 17 but corresponding to another position of adjustment.

Figure 1:
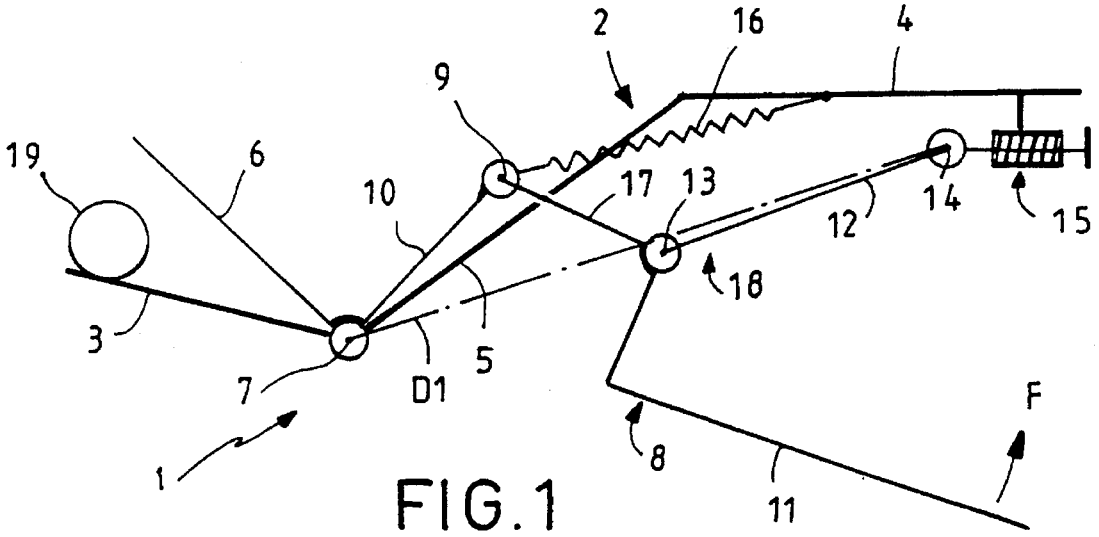
FIG. 1 is a diagram of the principle of the design of the locking pliers according to the invention in the open position.
Figure 2:
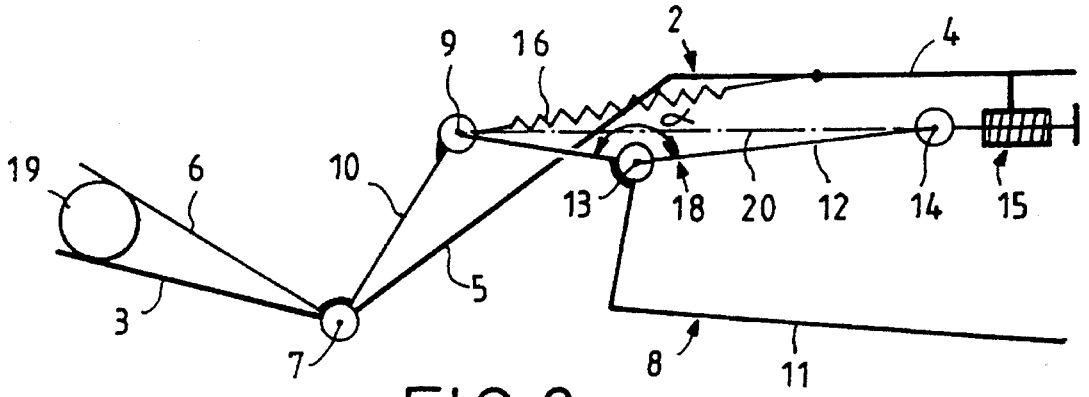
FIG. 2 is a similar diagram of the locking pliers in the position for taking hold of a part to be gripped.
Figure 3:
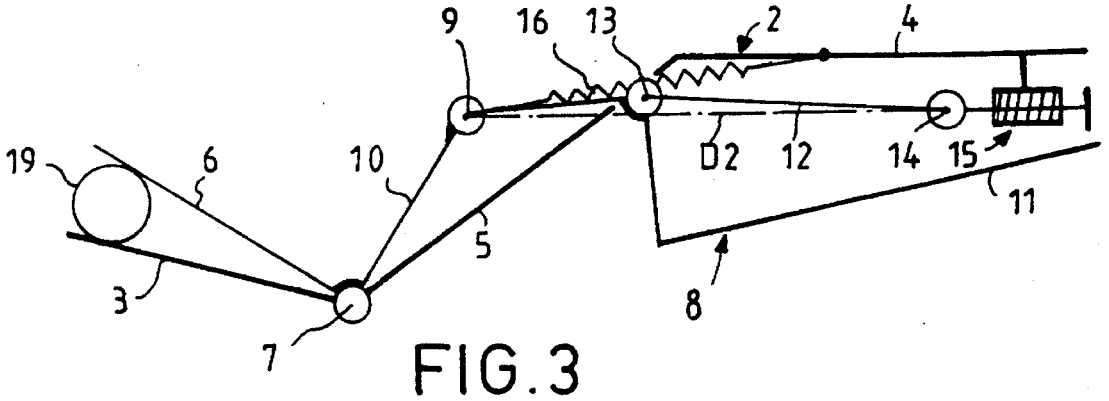
FIG. 3 is a similar view of the locking pliers in the final gripping position.

The general structure of locking pliers 1 according to the invention is diagrammatically illustrated in FIGS. 1 to 3. The locking pliers have a generally planar shape contained in the plane of the drawing and they will be described in their usual position of use.

The locking pliers 1 primarily include a fixed unit 2 having a generally very elongate S-shape which has a distal or front end part 3 constituting a fixed or stationary jaw, a proximal or rear end part 4 constituting a first handle or fixed handle, and an intermediate connecting part 5, a movable jaw 6 articulated by a transverse pivot pin 7 at the root of the fixed jaw and located above the latter, an actuating lever 8 having a generally Z-shape of which the distal or front end is articulated by a transverse pivot pin 9 to the free end of an arm 10 integral with the movable jaw, and the proximal or rear end part 11 constitutes a second handle or movable handle, a link 12 of which the distal or front end is articulated by a transverse pivot pin 13 to an intermediate point of the lever 8 and the proximal or rear end bears at a point 14 connected to the handle 4 but adjustable in position along the handle 4 by means of a mechanism 15, and a spring 16 which tends to open the locking pliers and which, in the illustrated embodiment, is a tensile spring stretched between the arm 10 and the handle 4.

The term "fixed" used here must of course be understood relatively, since it qualifies parts of a hand tool.

The handle 4 is the upper handle of the tool and extends roughly horizontally, the connecting part 5 extending forwardly slightly downwardly and the jaw 3 extending forwardly slightly upwardly. The lever 8 is mainly located below the body 2 but its front part upwardly intersects a straight line D1 joining the points 7 and 14. The pin 13 is located at the first crank of the lever 8 from the pivot point 9. The front section 17 of the lever 8 and the link 12 constitute a toggle mechanism 18 of the extension type which acts between the points 9 and 14. At rest (FIG. 1), the locking pliers are opened under the action of the spring 16 and the section 17 and the link 12 make an obtuse angle therebetween.

To grip a part 19 placed on the fixed jaw 3, the user moves the handle 11 upwardly toward the handle 4 (arrow F in FIG. 1). This action urges the pin 9 in the forward direction and the movable jaw 6 constantly seen by the user since it is located above the fixed jaw 3, comes into contact with the part 19 (FIG. 2). The toggle mechanism 18 then makes an angle, termed pressure angle, close to a flat angle and adjustable by means of the mechanism 15. In this position, the straight line D2 joining the pin 9 to the bearing point 14 is substantially coincident with the general axis of the fixed handle 4.

In continuing to raise the handle 11, the user causes the toggle mechanism to pass through the position of alignment thereof, and the abutment of two stops (not shown) of which one pertains to the movable unit 6, 8 and the other to the fixed unit 2, stops the motion slightly after this passage of the toggle mechanism through the alignment thereof, as shown in FIG. 3. The gripping force then acts on the fixed unit 2 with relatively low bending stresses on the latter.

FIGS. 4 to 7 show locking pliers of which all of the essential parts are made from blanked-out planar sheets and correspond to the diagrams of FIGS. 1 to 3.

The fixed unit 2 comprises four pieces of blanked-out planar sheet: two main generally triangular-shaped side walls 21 which are parallel and identically form the parts 4 and 5, i.e. the body of the tool, and two identical jaw parts 22 forming the fixed jaw 3. The two jaw parts 22 are placed against each other, interposed between the front parts of the two side walls 21 to which they are fixed by two rivets 23, and form a front spacer member for these two side walls.

The latter are also welded to a rear spacer member 24 provided with a longitudinal tapped hole 25, and the handle 4 is covered, at least on the top and side thereof, with an ergonomic grip covering 26.

The movable jaw and the arm 10 of FIGS. 1 to 3 are constructed in the form of a triangular part consisting of two identical pieces of sheet 27 placed flat against each other. The upper and rear corner of this part extends between the front ends of two parallel and identical longitudinal members 28 which constitute the lever 8. The link 12 is formed by two identical rectilinear sections 29 placed together and extending at the front between the longitudinal members 28 and at the rear between the side walls 21.

Figures 4, 5, 6, 7, 8, 9:
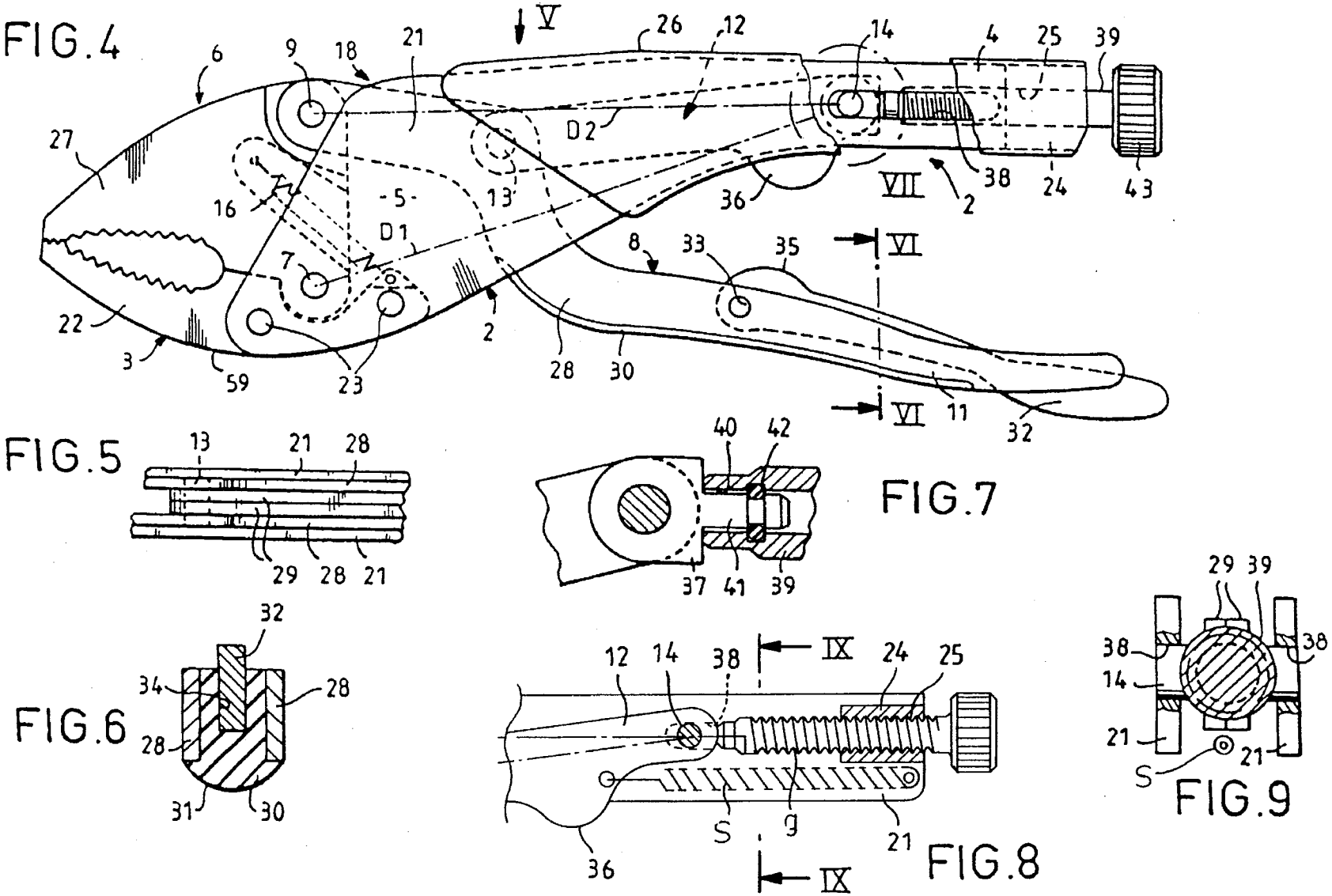
FIG. 4 is a view of locking pliers according to the diagram of the principle of the design of FIGS. 1 to 3.
FIG. 5 is a partial view seen in the direction of arrow V of FIG. 4.
FIG. 6 is a partial sectional view taken along line VI—VI of FIG. 4.
FIG. 7 is a view to a larger scale and partly in section of the detail VII of FIG. 4.
FIG. 8 is a view similar to FIG. 7 corresponding to an alternative embodiment.
FIG. 9 is a sectional view taken along line IX—IX of FIG. 8.
Figure 10:
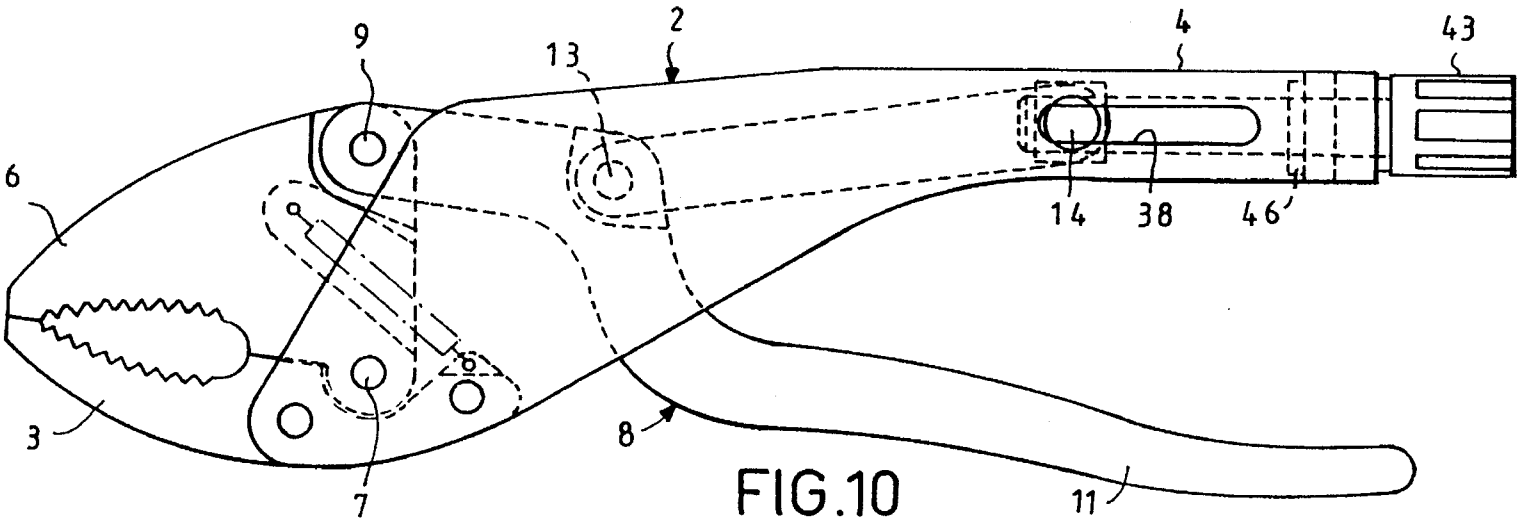
FIG. 10 is a view of an alternative embodiment of the locking pliers of FIG. 4 in a first position of adjustment.

The handle 11 along its entire length, between the longitudinal members 28, includes a spacer member-padding 30 of plastics material which slightly downwardly projects so as to form a rounded gripping surface 31 (FIG. 6). An unlocking lever 32 (which has been shown only in certain Figures) constituted by a single piece of flat sheet, is articulated at the front end thereof to an intermediate point 33 of the handle 11 and is received, at rest, in a longitudinal groove 34 provided in the upper side of the padding 30. The lever 32 extends rearwardly beyond the handle 11 and includes an upwardly projecting rounded cam 35 which, when the lever 32 is raised, cooperates with another rounded cam 36 projecting below the link 12 to effect unlocking. The unlocking is therefore achieved in a relatively smooth manner owing to the quasi-absence of a bending stress on the body 4, 5.

As can be seen in FIGS. 4 and 7, the rear end of the link 12 carries a transverse pin which extends through the two branches of a yoke 37 and has end portions guided in longitudinally extending oblong openings 38 in the side walls 21. An adjusting screw 39 is screwed from the rear in the tapped hole 25 and includes at the front end thereof a bore 40 in which the rearwardly extending stem 41 of the yoke 37 extends. The latter is immobilized in translation in the bore 40 by a circlip 42. The screw 39 may be rotated by an outer knob 43.

It will be observed that, in this embodiment, the spring 16 is stretched between the upper part of the movable jaw and the upper rivet 23. No other spring is required since the rear end of the link is connected to move in translation with the adjusting screw 39.

FIGS. 8 and 9 show an alternative embodiment in which the rear end of the link 12 is of semi-circular shape and merely bears against the front end of the screw 39 under the action of the spring 16 and optionally of another spring 5.

FIGS. 10 to 13 show another alternative embodiment of the adjusting mechanism 15. In this embodiment, the two parts 29 of the link 12 extend away from each other at an intermediate point of their length and their rear ends extend on each side of a block 44 in which the screw 39 is screwthreadedly engaged. Lateral cylindrical projections 45 of this block are guided in the openings 38 of the side walls 21. The rear part of the screw 39 is prevented from moving in translation relative to the spacer member 24, the aperture of which is smooth, by means of the knob 43 and a washer 46. In this way the rotating knob 43 always remains adjacent the rear end of the handle 4 irrespective of the selected adjustment.

Figure 11:
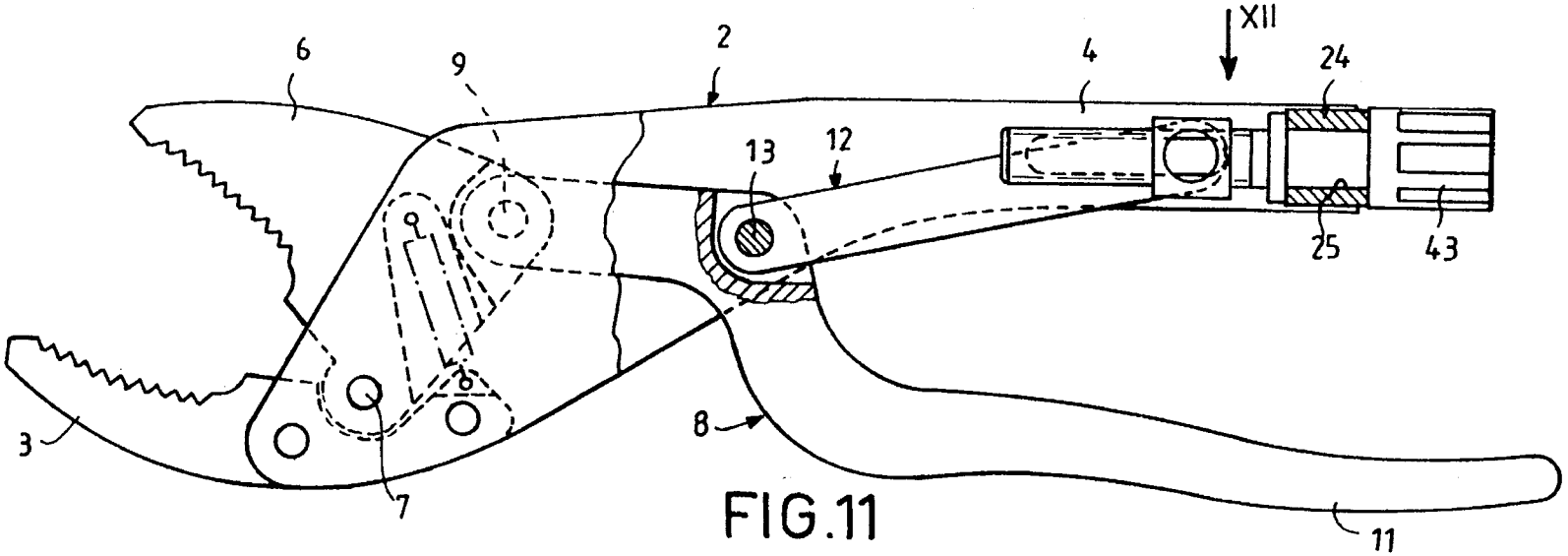
FIG. 11 is a view, with a part cut away and partly in section of the locking pliers of FIG. 10 in a second position of adjustment.
Figure 12:
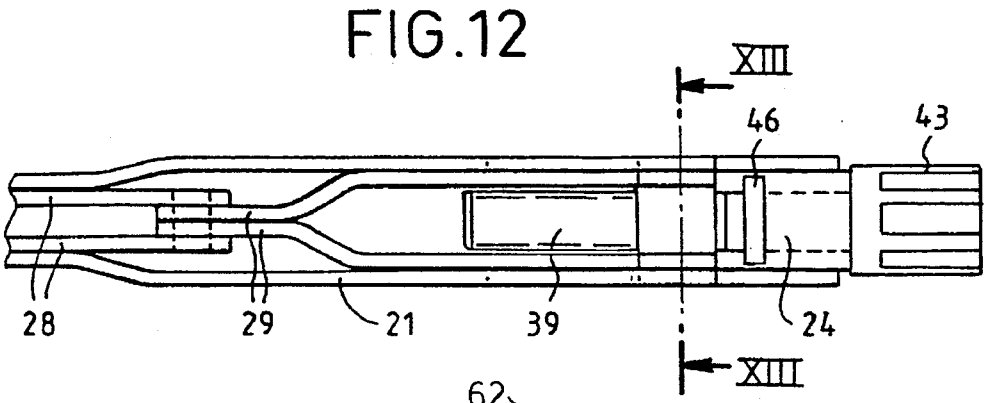
FIG. 12 is a partial view in the direction of arrow XII of FIG. 11.

In FIG. 11, it can be seen that it is the reciprocal abutment of the rear parts of the two jaws 3, 6 which defines the position of maximum opening of the locking pliers.

Figure 14:
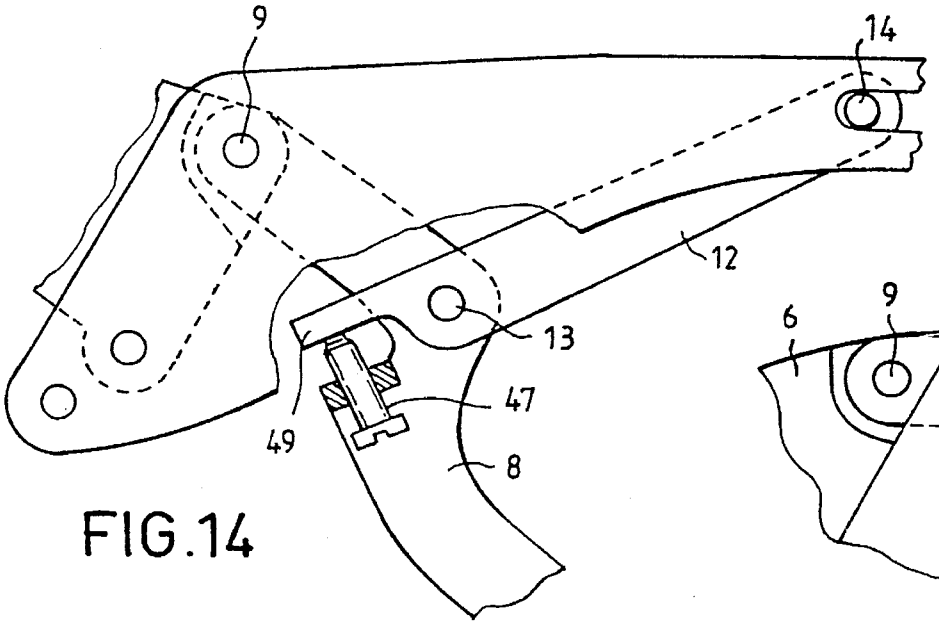
FIG. 14 is a partial view of another alternative embodiment.

FIG. 14 shows that the locking pliers may be provided with an adjustable opening stop so that the tool is always ready to be taken hold of with one hand. This stop is in the form of a screw 47 screwed in a tapped hole of a spacer member 48 provided in the lever 8 in the vicinity of the pin 13. The front end of the screw 47 abuts a forward extension 49 of the link 12 in the open position of the locking pliers.

Figure 15:
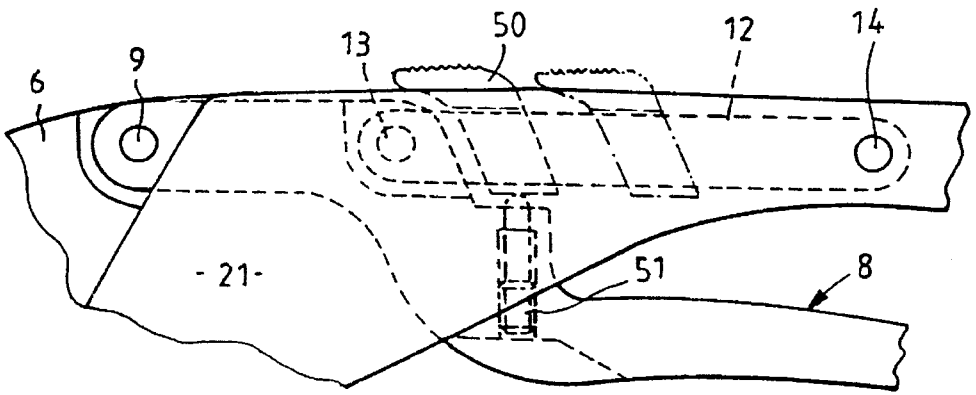
FIG. 15 is a partial view of a further alternative embodiment.
Figure 13:
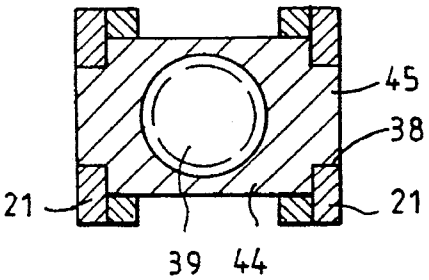
FIG. 13 is a sectional view taken along line XIII—XIII of FIG. 12.

FIG. 15 shows an alternative embodiment in which the locking pliers may be converted at will into pliers allowing a multiplication of the gripping force. To this end, the fixed handle 4 carries a sliding control member 50 movable between a forward position, shown in full lines, and a rear position, shown in dot-dash lines. Further, the lever 8 includes, slightly to the rear of the pin 13, a set-screw 51 the front end of which projects upwardly.

When the sliding control member 50 is moved back, the screw 51 has no particular function and the tool is used as locking pliers in the manner described hereinbefore.

On the other hand, when the sliding control member is moved forward, it constitutes a stop for the screw 51 just before the alignment of the toggle mechanism is reached when the two handles 4 and 11 are moved toward each other. The gripping force then obtained may be adjusted by turning the screw 51 and the tool returns to the open position as soon as the manual force applied is released.

FIG. 16 shows an alternative embodiment which includes means for displaying the adjustment. The link 12 has a tapered extension 52 extending in front of the pin 13 and behind an arcuate opening 53 centered on the pin 13 and provided in each longitudinal member 28. A graduated scale 54 is provided on the outside of the latter. In this case, as shown in dot-dash lines, any covering 26 which might be provided on the body of the tool must include on each side a window 55 which reveals the opening 53 and the associated graduation 54.

In the alternative embodiment of FIGS. 17 and 18, the adjustment is disclosed by a cranked extension 56 of the link 12 which extends downwardly from the pin 13, the free end thereof extending downwardly beyond the lower surface 57 of the lever 8 and carrying a series of lines 58. Depending on the angle of pressure of the toggle mechanism 18, a variable number of these lines is revealed.

It will be observed that the design of the locking pliers according to the invention permits easily avoiding the risk of the user inadvertently inserting a finger in the region of the articulated mechanism and therefore affords an advantage from the point of view of safety during use.

Further, the arcuate lower surface 59 of the front part of the fixed unit 2 permits easily passing the pliers along a support surface for taking hold of the part to be gripped placed close to this support surface, in the same manner as a tailor passes his scissors between the cloth and the support under the latter.

Figure 19:
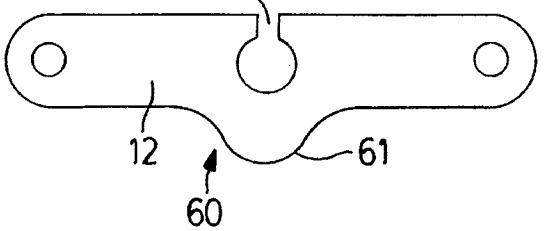
FIG. 19 is a view of an alternative embodiment of the link.

In the alternative embodiment of FIG. 19, the link 12 comprises a U-shaped middle part 60 projecting from the side of the lever 8 which defines a boss 61 and a slot 62. The latter perpendicularly intersects the longitudinal axis of the link.

When a moderate grip is desired, for example for gripping a fragile part, the screw 39 is so adjusted that upon the passage through the alignment state of the toggle mechanism, the slot 62 remains open. The gripping force is then determined with precision by the longitudinal resilience of the link 12.

On the other hand, when it is desired to obtain a strong grip by means of another adjustment of the screw 39, another important advantage is obtained. During the first part of the travel of the movable handle, the slot 62 is open and as before defines a moderate and roughly constant grip. The parts held between the jaws of the tool are therefore pre-gripped and it is possible to adjust the relative positions thereof. Thereafter, in continuing to move the two handles toward each other, the operator closes the slot 62 so that the link becomes rigid and can then transmit very high gripping forces.

Note that, instead or in addition, the front part 21 of the lever 8 may include a longitudinally resilient region.

It will be understood that the boss 61 may perform the function of the unlocking projection 36 of FIG. 4.

What is claimed is:

1. Locking pliers comprising:

a stationary unit of generally elongate shape having a front end portion and a rear end portion, said stationary unit defining a stationary jaw at said front end portion and a stationary handle at said rear end portion;

a movable unit including a movable jaw, a pivot pin pivotally mounting said movable jaw on said stationary jaw, an actuating lever having a front end portion and a rear end portion defining a movable handle, and a first articulation pivotally connecting said front end portion of said actuating lever to said movable jaw;

a rear bearing member connected to said stationary handle and defining a rear bearing point;

a link having a front end portion pivotally connected by a second articulation to an intermediate point of said actuating lever, and a rear end portion positioned adjacent said rear bearing point;

a means for adjusting the position of said rear bearing point along said fixed handle; and a return spring associated with said movable jaw and said stationary jaw to open said movable jaw relative to said stationary jaw, wherein said actuating lever crosses a first straight line extending between said pivot pin and said rear bearing point, an angular position of said first straight line relative to said stationary handle is modified by a displacement of said rear bearing point by said adjusting means along said stationary handle, and, in any closed position of said locking pliers, said stationary handle extends substantially along a second straight line extending between said first articulation and said rear bearing point.

2. Locking pliers as claimed in claim 1, comprising means independent of said return spring for maintaining said rear end portion of said link in a position adjacent said adjustable rear bearing point.

3. Locking pliers as claimed in claim 2, wherein said adjusting means comprises an adjusting screw threadedly engaged in said rear end portion of said stationary unit, and said rear end portion of said link is pivotally mounted relative to said adjusting screw.

4. Locking pliers as claimed in claim 3, wherein said stationary handle defines two longitudinal oblong openings and said rear bearing member comprises a transverse pin carried by said rear end portion of said link and guidedly engaged in said two oblong openings.

5. Locking pliers as claimed in claim 2, wherein said stationary handle defines two longitudinal oblong openings and said rear bearing member comprises a transverse pin carried by said rear end portion of said link and guidedly engaged in said two oblong openings.

6. Locking pliers as claimed in claim 2, wherein said adjusting means comprises a block carried by said rear end portion of said link and guided for movement along said fixed handle, and a stationary adjusting screw rotatively mounted in said rear end portion of said stationary unit and threadedly engaged in said block.

7. Locking pliers as claimed in claim 2, wherein said adjusting means comprises an adjusting screw threadedly engaged in said rear end portion of said stationary unit, and a second spring biasing said rear end portion of said link against said adjusting screw.

8. Locking pliers as claimed in claim 1, wherein said return spring is stretched between said stationary jaw and said movable jaw.

9. Locking pliers as claimed in claim 1, further comprising a control member slidably mounted on said stationary unit and movable between two positions, wherein in one of said two positions said control member is operatively associated with said link for preventing said link from passing through a position of alignment with a longitudinal axis of said stationary handle.

10. Locking pliers as claimed in claim 1, wherein one of said link and said actuating lever has a graduated scale thereon, and the other of said link and said actuating lever has an index which cooperates with said graduated scale to indicate the position of said rear bearing point.

11. Locking pliers as claimed in claim 1, wherein said stationary unit laterally overlaps at least a major part of an area of each side of said movable unit defined by said pivot pin, said first articulation and said bearing point.

12. Locking pliers as claimed in claim 1, wherein said stationary handle is constructed from a blanked-out planar sheet.

13. Locking pliers as claimed in claim 12, wherein said stationary handle includes spacer members.

14. Locking pliers as claimed in claim 1, wherein said actuating lever is constructed from a blanked-out planar sheet.

15. Locking pliers as claimed in claim 14, wherein said actuating lever includes spacer members.

16. Locking pliers as claimed in claim 1, wherein said link is constructed from a blanked-out planar sheet.

17. Locking pliers as claimed in claim 16, wherein said link includes spacer members.

18. Locking pliers as claimed in claim 1, wherein said jaws are constructed from blanked-out planar sheets.

19. Locking pliers as claimed in claim 1, further comprising an unlocking lever pivotally mounted on said actuating lever at an intermediate point of said actuating lever, wherein said actuating lever includes a soft padding which receives said unlocking lever in one position thereof.

20. Locking pliers as claimed in claim 1, wherein said link has a longitudinal resilience in compression up to a predetermined compression force.

21. Locking pliers as claimed in claim 1, wherein said resilience is imparted by a U-shaped part which defines a slot which intersects a line of action in compression of said link and said slot is adapted to close when said predetermined compression force is reached.

22. Locking pliers as claimed in claim 1, wherein said actuating lever has a longitudinal resilience in compression up to a predetermined compression force.

23. Locking pliers as claimed in claim 22, wherein said resilience is imparted by a U-shaped part which defines a slot which intersects a line of action in compression of said lever and said slot is adapted to close when said predetermined compression force is reached.

24. Locking pliers comprising:

a stationary unit of generally elongate shape having a front end portion and a rear end portion, said stationary unit defining a stationary jaw at said front end portion and a stationary handle at said rear end portion;

a movable unit including a movable jaw, a pivot pin pivotally mounting said movable jaw on said stationary jaw, an actuating lever having a front end portion and a rear end portion defining a movable handle, and a first articulation pivotally connecting said front end portion of said actuating lever to said movable jaw;

a rear bearing member connected to said stationary handle and defining a rear bearing point;

a link having a front end portion pivotally connected by a second articulation to an intermediate point of said actuating lever, and a rear end portion positioned adjacent said rear bearing point;

a means for adjusting the position of said rear bearing point along said fixed handle; and a return spring associated with said movable jaw and said stationary jaw to open said movable jaw relative to said stationary jaw, wherein said actuating lever crosses a first straight line extending between said pivot pin and said rear bearing point, an angular position of said first straight line relative to said stationary handle is modified by a displacement of said rear bearing point by said adjusting means along said stationary handle, and, in any closed position of said locking pliers, said stationary handle extends substantially along a second straight line extending between said first articulation and said rear bearing point, and when a workpiece having any given dimension in a range of dimensions is disposed between said stationary jaw and said movable jaw, there is at least an adjusted position of said rear bearing point for which, in a closed position of said stationary and movable jaws, said link is over-center relative to a longitudinal axis of said stationary handle, and said closed position is a stable position.

* * * * *